United States Patent [19]

Shah et al.

[11] Patent Number: 4,848,556

[45] Date of Patent: Jul. 18, 1989

[54] LOW POWER COIN DISCRIMINATION APPARATUS

[75] Inventors: Govind Shah, East Windsor; Andrew L. Pester, Belle Mead; Carl M. Stern, Lawrenceville, all of N.J.

[73] Assignee: Qonaar Corporation, Rolling Meadows, Ill.

[21] Appl. No.: 144,610

[22] Filed: Jan. 7, 1988

Related U.S. Application Data

[63] Continuation of Ser. No. 720,631, Apr. 8, 1985, abandoned.

[51] Int. Cl.[4] ..... G07D 5/04; G07F 7/00

[52] U.S. Cl. ..... 194/212; 194/302; 194/334; 194/339; 194/342; 194/350; 177/51

[58] Field of Search ..... 194/212, 216, 227, 302, 194/317, 327, 331, 332, 334, 338, 339, 348, 342, 350; 177/51; 73/12, 163; 356/379, 380, 398; 364/567, 568; 209/592

[56] References Cited

U.S. PATENT DOCUMENTS

| | | | |
|---|---|---|---|
| 2,340,441 | 2/1944 | Toce et al. | 194/339 X |
| 2,397,878 | 4/1946 | Michaels | 194/227 |
| 3,099,749 | 7/1963 | Williams | 356/379 |
| 3,211,267 | 10/1965 | Bayha | 194/ |
| 3,243,030 | 3/1966 | Tryon et al. | 194/343 |
| 3,576,244 | 4/1971 | Ptacek | 194/318 |
| 3,682,286 | 8/1972 | Prumm | 194/334 X |
| 3,739,895 | 6/1973 | Fougere et al. | 194/339 X |
| 3,776,338 | 12/1973 | Johnson | 194/244 |
| 3,788,466 | 1/1974 | Wilson et al. | 73/12 X |
| 3,939,953 | 2/1976 | Miyazawa | 194/317 |
| 3,939,954 | 2/1976 | Collins | 194/205 |
| 3,977,507 | 8/1976 | Kaiser | 194/334 X |
| 3,978,962 | 9/1976 | Gregory, Jr. | 194/328 |
| 4,082,099 | 4/1978 | Iwersen | 133/3 R |
| 4,124,111 | 11/1978 | Hayashi | 194/334 |
| 4,249,648 | 2/1981 | Meyer | 194/212 |
| 4,267,916 | 5/1981 | Black et al. | 194/317 |
| 4,346,798 | 8/1982 | Agey | 194/348 |
| 4,436,103 | 3/1984 | Dick | 133/3 D |
| 4,436,196 | 3/1984 | Crisp | 194/318 |
| 4,442,850 | 4/1984 | Austin et al. | 133/3 H |
| 4,460,080 | 7/1984 | Howard | 194/317 |
| 4,474,281 | 10/1984 | Roberts et al. | 194/218 |
| 4,531,625 | 7/1985 | Yonekura et al. | 194/334 |
| 4,717,007 | 1/1988 | Van Horn | 194/343 |
| 4,733,766 | 3/1988 | Roberts et al. | 194/327 X |

FOREIGN PATENT DOCUMENTS

| | | |
|---|---|---|
| 0038911 | 11/1981 | European Pat. Off. . |
| 0645201 | 9/1984 | Switzerland . |

*Primary Examiner*—Joseph J. Rolla
*Assistant Examiner*—Edward S. Ammeen
*Attorney, Agent, or Firm*—James P. Ryther

[57] ABSTRACT

A low power coin discriminator detects and identifies the denomination of a coin to activate a parking meter, telephone, or vending machine device. Initially the device is in a low power, dormant state. Insertion of a coin into the discrimator trips a switch which produces a wake-up pulse which turns on a microprocessor. The coin falls upon a piezoelectric element, a signal from which causes the microprocessor to activate a photoelectric sensor. The coin moves through the photoelectric sensor which determines the net cross-sectional area of the coin. The microprocessor samples the output of the photoelectric sensor to detect the minimum light incident upon the sensor at the point of maximum eclipse of the light beam. The microprocessor also samples the output of an integrator which integrates the output of the piezoelectric element to produce a numerical value proportional to the mass of the coin. If the output of the photoelectric sensor indicates that the coin is within acceptable limits then the measured mass of the coin is also compared to the corresponding limits. If the coin is deemed to be valid, its denomination is recorded in a conventional manner. Once the discrimination process is complete the circuit automatically returns to its original low power, domant state.

26 Claims, 8 Drawing Sheets

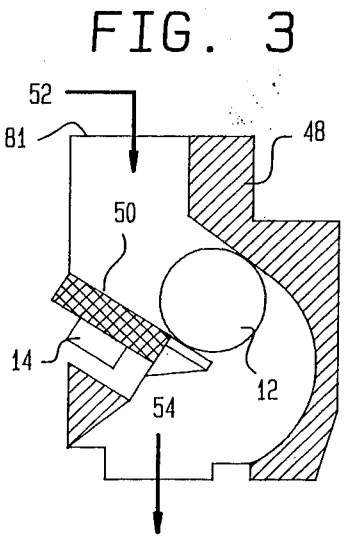
FIG. 3
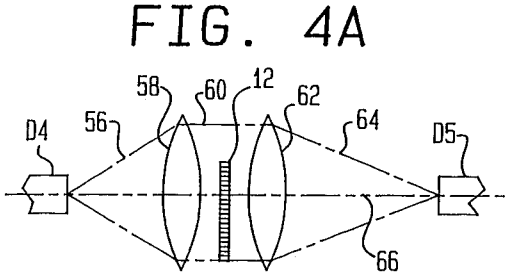
FIG. 4A
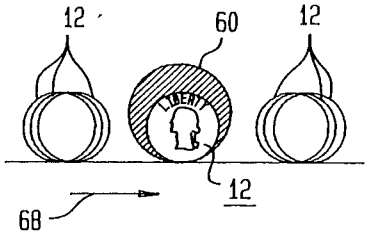
FIG. 4B
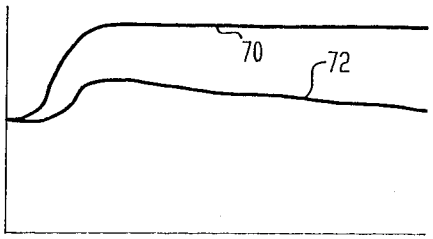
FIG. 5A
FIG. 5B
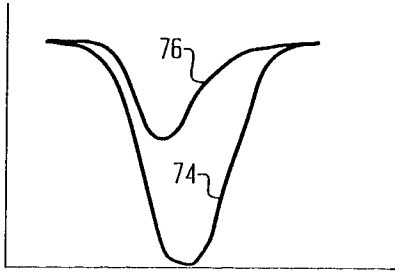
FIG. 5C

LOW POWER COIN DISCRIMINATION APPARATUS

This application is a continuation of application Ser. No. 720,631, filed 4/8/85 now abandoned.

BACKGROUND OF THE INVENTION

1. Field of the Invention

The invention relates to a low power apparatus for detecting the validity and denomination of a coin.

2. Description of the Prior Art

There is believed to be a substantial need for low power coin discriminators for use in devices such as parking meters, telephones, and vending machines. Most prior art coin discriminating apparatuses tend to be mechanical in nature. Only a few moderately reliable electronic devices are known. Since most prior art electronic devices are located near a source of power, the problem of power consumption has never been a major concern. However, there are certain environments, such as parking lots, where external power isn't available. Therefore, it was necessary to search for a low power, highly accurate and highly rugged unit. Since no prior art devices appeared to fit that description it was necessary to invent one that did.

The use of piezoelectric elements in the context of coin discrimination is not common. However, U.S. Pat. No. 3,776,338 does disclose a piezoelectric detector used for detecting the presence of a coin. The use of a rudimentary striking pad to cover the surface of a piezoelectric element is also discussed. Another discussion of the use of piezoelectric elements is found in an article entitled "Poly(vinylidene) Fluoride Used for Piezo Electric Coin Sensors". The article was written by G. R. Crane of Bell Labs and appeared in Volume SU 25, No. 6, (November 1978) of the IEEE Transactions on Sonics and Ultrasonics at pages 393–395.

Some prior art references describe systems which employ two or more steps to detect coins. For example, U.S. Pat. No. 4,082,099 discloses a two step method for coin discrimination. The first step is the detection of the coin by a metal sensor. The second step employs photoelectric elements. Similarly, U.S. Pat. No. 4,436,196 discloses another two-part test and includes a discussion of the use of an LED and a microprocessor. Likewise, U.S. Pat. No. 3,211,267 discloses a dual test to determine the weight and diameter of the coin.

A number of prior art references discuss the use of other photoelectric devices to detect the presence and/or areas and/or diameters of coins. Note specifically that U.S. Pat. Nos. 3,978,962; 4,249,648; 4,267,916 and 4,474,281 disclose the use of arrays of LED's to detect coin parameters such as velocity, area, diameter, etc. Other patents of interest with regard to the photoelectric detection aspects of the present invention are U.S. Pat. Nos. 3,939,954; 4,436,103 and 4,442,850. Insofar as understood none of the prior art references cited above or known to the inventor have the same structure or function as the unique invention described herein.

SUMMARY OF THE INVENTION

Briefly described the invention is comprised of a low power coin discrimination apparatus for use in parking meters, telephones, vending machines and similar devices. The coin discriminator includes a piezoelectric transducer for measuring the mass of the coin and a photoelectric sensor for sensing the area of the coin.

The circuit begins in a low power, dormant state. A coin is initially inserted into the meter. Movement of a coin transfer handle activates a limit switch which generates a wake-up pulse. The handle movement also forces the coin to enter a chute causing it to fall on the piezoelectric transducer. A cellular urethane pad covers the piezoelectric element and serves to dampen oscillations generated by the coin impact. If a large enough pulse is generated by the impact on the piezoelectric transducer, an infrared LED in the photoelectric sensor section of the circuit is turned on by a controlling microprocessor. The photosensor portion of the circuit preferably includes a photodiode illuminated by the infrared LED. A microprocessor circuit digitally samples the output of the photodiode to determine the minimum illumination (at the point of maximum eclipse) which in turn represents the net area of the coin. Therefore the photosensor can discriminate between invalid coins which have holes and valid coins of the same diameter. The signal generated by the coin impacting on the piezoelectric transducer is integrated and then sampled by the microprocessor in ordr to determine the mass of the coin. The microprocessor first uses the information generated by the photoelectric sensor to determine if the coin is within acceptable area limits. If it passes the photosensor test, then the mass information from the piezoelectric transducer is also compared to the corresponding limits as a dual accuracy check. The discriminator automatically returns to a dormant state once it has completed the discrimination process. The invention is preferably used in a parking meter, however, it could also be used in other contexts such as telephones and vending machines.

These and other features of the invention will be more fully understood by reference to the following drawings.

BRIEF DESCRIPTION OF THE DRAWINGS

FIG. 3 is a cross-sectional view of the coin chute showing the manner in which the coin impinges on the piezo electric transducer.

FIG. 4A illustrates the photo optical system for measuring the area of a coin.

FIG. 4B illustrates the manner in which a coin eclipses the optical system shown in FIG. 4A.

FIG. 5A illustrates the waveforms of two different signals produced when the different coins impinge on the piezoelectric element.

FIG. 5B illustrates the integrals of the signals shown in FIG. 5A for two different coin denominations.

FIG. 5C illustrates the signal output from the photoelectric coin area detection system of FIGS. 4A and 4B for two different coin denominations

DETAILED DESCRIPTION OF THE INVENTION

During the course of this description like numbers will be used to identify like elements according to the different views and figures which illustrate the invention.

Figure 1:
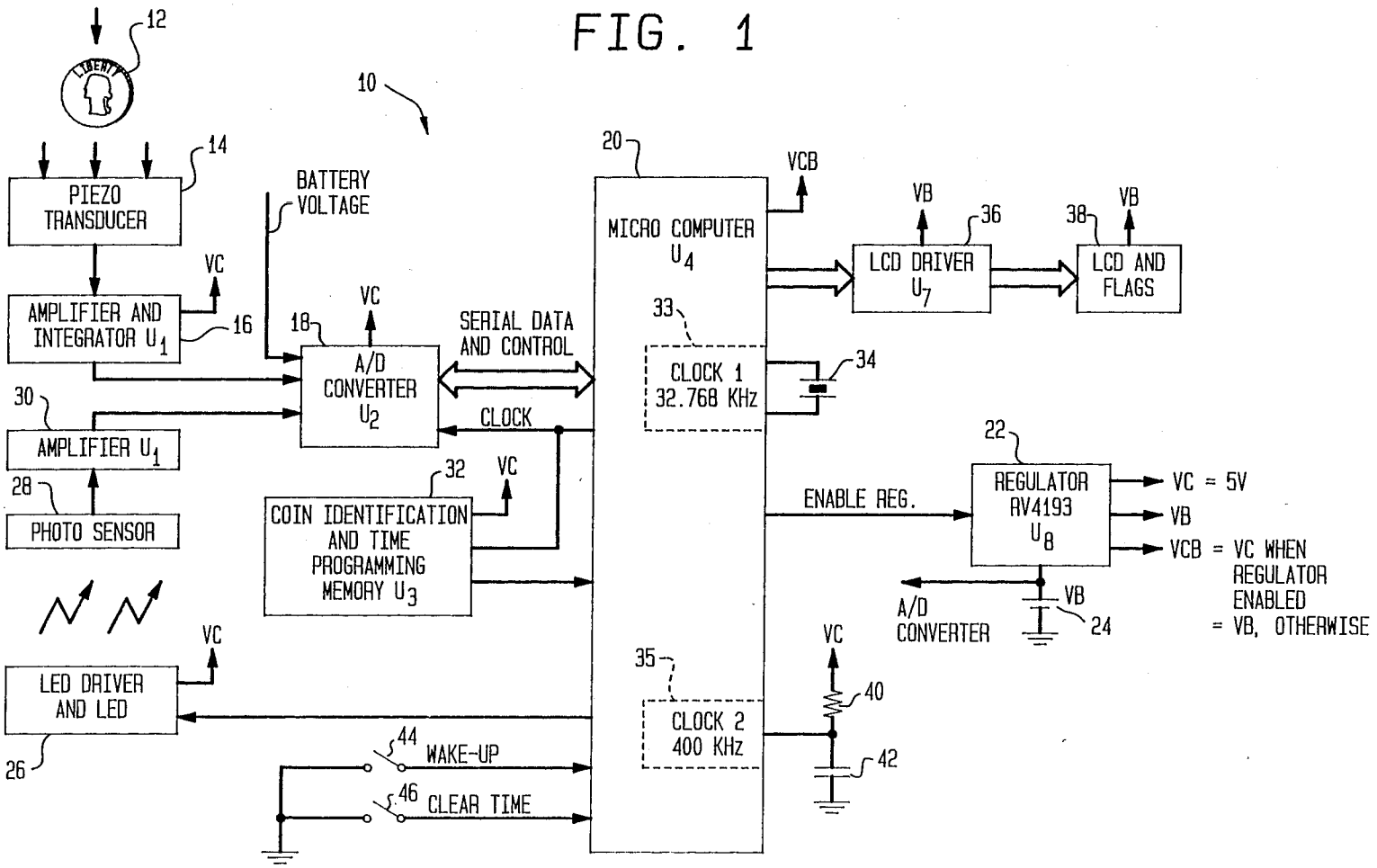
FIG. 1 is a block diagram of the preferred embodiment of the invention.

The preferred embodiment of the invention 10 is illustrated in FIG. 1 in block diagram form and in structural form in FIGS. 3–6K. Initially the circuit 10 is in a dormant low power state. A user starts the meter by inserting a coin 12 into slot 81 and then moving handle 98 to the right causing the coin transfer block 96 to impinge upon and activate limit-type wake-up switch 44. Simultaneously the coin 12 is moved by housing 102 to the edge of base 114 of coin entrance frame piece 80 causing it to fall down chute 52. Wake-up switch 44 causes the circuit to enter a low power, pre-active state for a maximum of about 500 milliseconds. During the 500 millisecond preactive period the microprocessor is preconditioned to look for a signal from the piezo transducer 14. Also the 32.768 $kH_z$ internal clock 33 controlled by crystal 34 is automatically disconnected and replaced by a faster but less accurate 400 $kH_z$ clock 35. The clock rate of the 400 $kH_z$ clock is established by the resistance/capacitance network 40 and 42 which corresponds to resistors R11 and C4 in FIG. 2. The impact of coin 12 on piezoelectric element 14 causes the LED D4 of drive circuit 26 to turn on in advance of coin 12. If no coin impacts on piezoelectric transducer 14 within 500 milliseconds, then the circuit automatically turns off. The output of piezoelectric transducer 14 is integrated by amplifier and integrator circuit 16 and fed as an input to analog-to-digital converter 18. The output of analog-to-digital converter 18 is fed to microprocessor 20. LED circuit 26 illuminates photosensor 28 which produces an output that is amplified by amplifier circuit 30 and fed as a second input to the analog-to-digital converter circuit 18. Activation of the piezoelectric transducer 14 produces an enable signal to voltage regulator 22 which causes the voltage $V_{CB}$ to jump from a low voltage $V_B$ to a higher voltage $V_C$ (5 volts) which is sufficient to drive LED D4. Regulator 22 also provides a "low battery" signal back to microprocessor 20 to indicate if the power source is running low.

The coin chute 52 is constructed so that the coin 12 will pass between LED circuit 26 and photosensor 28 after it has impacted upon piezoelectric transducer 14. Microcomputer 20 samples the output from analog-to-digital converter 18 at very short intervals to determine when a coin 12 has achieved a maximum eclipse of the light between LED circuit 26 and photosensor circuit 28.

A coin identification and time programming memory circuit 32 is programmed to assist microprocessor 20 in the identification of a coin 12 of unknown denomination. The output from microprocessor 20 acts as an input to LCD driver circuit 36 which in turn drives the LCD and flags of circuit 38. The circuit 10 may be initialized by the manual operation of clear time switch 46.

Figure 2:
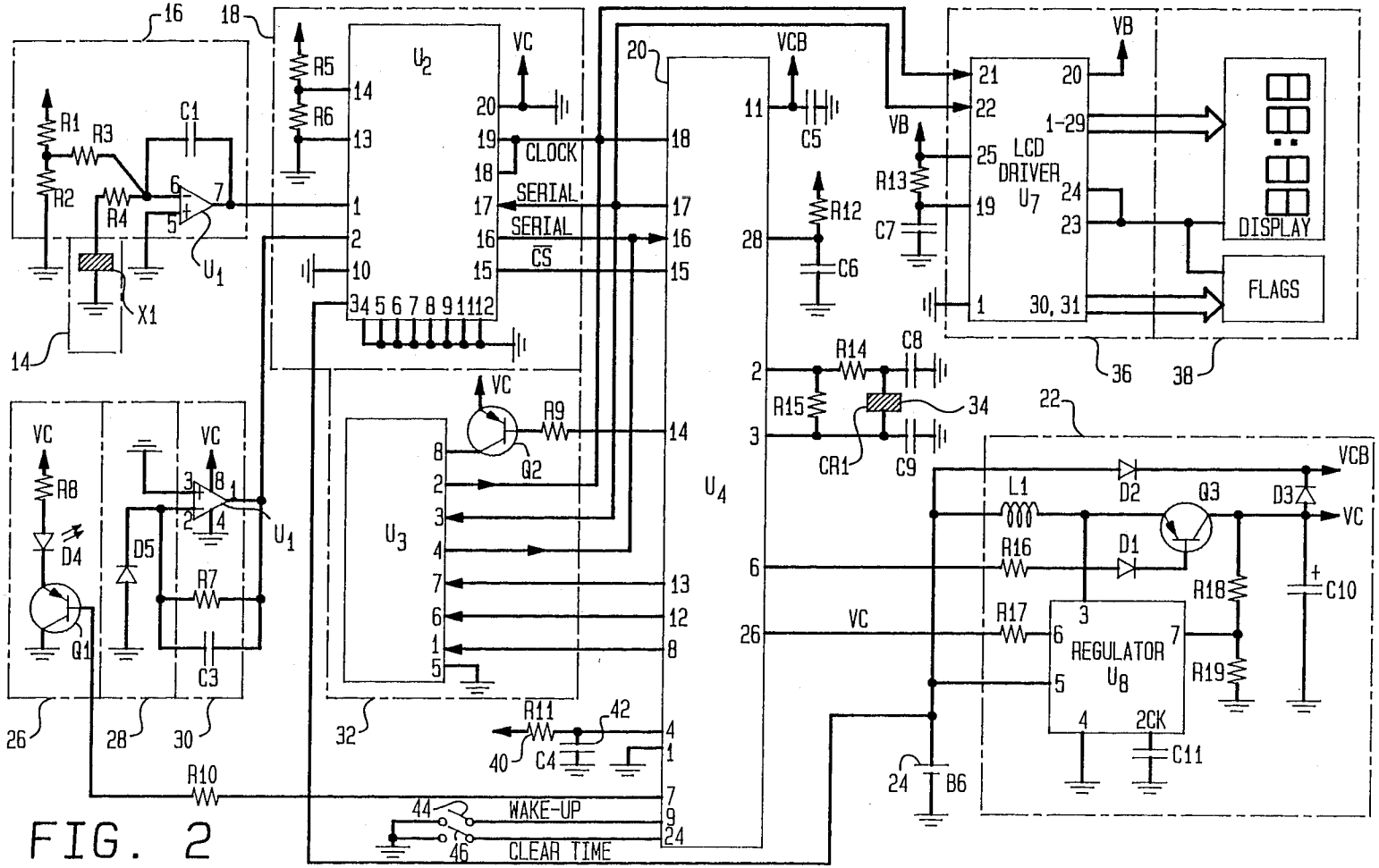
FIG. 2 is a detailed schematic diagram of the preferred embodiment of the invention illustrated in FIG. 1.

FIG. 2 is a detailed schematic diagram of the preferred embodiment of the invention illustrating all of the important specific details of the circuitry. Reference also should be made to the following parts list which further identifies the values and origin of the electrical components:

PARTS LIST

A. INTEGRATED CIRCUITS

| Item No. | Part No. | Manufacturer | Description |
|---|---|---|---|
| U1 | TLC27M4AIM | Texas Instruments | Operational Amp |
| U2 | TLC541IN | Texas Instruments | A/D Converter |
| U3 | X2443PI | Xicor | NOVRAM |
| U4 | COP324CN | National Semi. | Microprocessor |
| U7 | MM5483N | National Semi. | LCD Driver |
| U8 | RV4193NB | Raytheon | Regulator |

B. CAPACITORS

| Item No. | Description |
|---|---|
| C1 | 100 pf Polystyrene + 2.5% |
| C2 | .1 uf Mono CD Bypass |
| C3 | 100 pf DM Mica 5% |
| C4 | .047 uf Poly + 5% |
| C5 | .1 uf Mono CD Bypass |
| C6 | 82 pf DM Mica 5% |
| C7 | 470 pf DM Mica 5% |
| C8 | 50 pf DM Mica 5% |
| C9 | 50 pf DM Mica 5% |
| C10 | 470 uf, 6.3 V Electrolytic |
| C11 | 56 pf DM Mica 5% |

C. RESISTORS

| Item No. | Description |
|---|---|
| R1 | 2.4M 5% 1/4W Carbon |
| R2 | 10K 5% 1/4W Carbon |
| R3 | 20M 5% 1/4W Carbon |
| R4 | 10M 5% 1/4W Carbon |
| R5 | 10K 1% RN55D Type MF |
| R6 | 40K 1% RN55D Type MF |
| R7 | 1M 5% 1/4W Carbon |
| R8 | 180 5% 1/4W Carbon |
| R9 | 4.7K 5% 1/4W Carbon |
| R10 | 4.7K 5% 1/4W Carbon |
| R11 | 1M 5% 1/4W Carbon |
| R12 | 15K 5% 1/4W Carbon |
| R13 | 1M 5% 1/4W Carbon |
| R14 | 220K 5% 1/4W Carbon |
| R15 | 20M 5% 1/4W Carbon |
| R16 | 4.7K 5% 1/4W Carbon |
| R17 | 360K 5% 1/4W Carbon |
| R18 | 51.1K 1% RN55D Type MF |
| R19 | 16.9K 1% RN55D Type MF |

D. MISCELLANEOUS

| Item No. | Part No. | Description |
|---|---|---|
| L1 | 300MH | Inductor, 1/4W style, molded |
| CR1 | CXIV-32.768 kHz | Satek Inc., 32.768 kHz, crystal |
| D1 | IN914(1N4148) | Diode |
| D2 | HSCH 1001 | Diode |
| D3 | HSCH 1001 | Diode |
| D4 | LD242-2 | LED, Siemens |
| D5 | SFH206 | Photodiode, Siemens |
| Q1 | 2N3906 | Transistor |
| Q2 | 2N3906 | Transistor |
| Q3 | 2N4401 | Transistor |
| X1 | 16500-5A | Piezo Electric Ceramic Disc, Vernitron Piezoelectrics |

-continued

| PARTS LIST | | |
|---|---|---|
| B1,B2,B3 | MN1500 | Alkaline Battery, Duracell (−29° C. to +70° C.) |
| | or | |
| B4,B5 | BR-2/3A-1P | Lithium Battery, Panasonic (−40° C. to +85° C.) |
| LCDl | Excelix 4320-RPQ-0 | Excel Technology, 4 Digit Display |
| LCD2 | Excelix Flag | Excel Technology, Custom LCD |
| LCD3 | Excelix Flag | Excel Technology, Custom LCD |

FIG. 3 shows the progress of a coin 12 through the coin chute 48. After the coin is introduced into the coin slot 81, it drops down the chute 52 and impacts on cellular urethane shock absorbing material 50. The impact of coin 12 is dampened by shock absorbing material 50 and transmitted to piezoelectric transducer 14. The shock absorbing material 50 preferably comprises a cellular urethane such as PORON® No. 4701 manufactured by the Rogers Corporation. The signal produced by the piezoelectric transducer 14 is integrated by the circuit 10 in FIG. 1 to produce an output proportional to the mass of the coin 12. By rigidly controlling the fall of the coin 12 through a given unchangeable distance it is possible to accurately produce repeatable results. Therefore, a coin 12 falling through the chute 52 will always produce the same impulse or impact on the piezoelectric transducer 14. Accordingly, the integral of the impulse signal will always produce the same result indicative of the mass of the coin. Piezoelectric transducer 14 is preferably located at an angle with respect to the fall of the coin 12 so as to allow the coin to proceed on the track.

The signal output from the piezoelectric transducer is illustrated by graphs 67 and 68 in FIG. 5A. Graph 67 is directly proportional to the impulse created by a ten cent coin 12 striking the PVC shock absorbing material 50. Without the shock absorbing material 50 the impulse curve 67 would not be as smooth. After coin 12 rolls away the curve 67 returns to a straight line. Waveform 68 represents the impact of a twenty-five cent coin 12 for comparison purposes. The peak impulse of voltage generated by the impact of twenty-five cent coin 12 is approximately 8 volts. The 8 volt signal produced by transducer 14 represents the impulse, i.e. momentum of the twenty-five cent coin 12. Signal 67 or 68 acts as an input to the integrator subcircuit 16 formed by operational amplifier U1, resistor R4 and capacitor C1. The output of amplifier and integrator circuit 16 is shown as waveforms 70 and 72 in FIG. 5B. Waveform 70 is the integrated output of the impulse created by the fall of a twenty-five cent piece 12. Waveform 72 is the integrated output of the impulse formed by the fall of a ten cent piece 12. Since the integral of the impulse, i.e. momentum of a coin is proportional to the mass, then it is clear that the curves 70 and 72 are uniquely characteristic of the masses of twenty-five and ten cent pieces 12 respectively.

Analog-to-digital converter 18 samples the output waveforms 70 or 72 from amplifier and integrator circuit 16 every 100 microseconds under the control of microcomputer 20 and stores the peak voltage (P) in memory. If the peak P exeeds a minimum threshold, indicating a possibly valid coin, the microcomputer 20 prepares to turn LED circuit 26 on. However, before actually turning on the LED $D_4$, the microcomputer circuit 20 samples the output of the photodetector amplifier 30 and stores that value in memory as voltage a $V_o$. Microcomputer 20 then turns on the current to the infrared LED $D_4$ and starts sampling the output voltage from the photodetector $D_5$ as amplified by amplifier circuit 30.

After the coin 12 has passed the piezoelectric transducer 14 it continues to roll down the chute 52 into the vicinity of the opitcal path area 54. FIG. 4A is a diagrammatic representation of the coin 12 as it passes through the optical area measurement zone 54. LED $D_4$ produces an infrared light beam 56 which illuminates collimating lens 58. The collimated infrared beam 60 shines across the path of the coin 12. Light 60 which is not eclipsed by coin 12 impinges on converging lens 62 which produces a converging infrared beam 64 which in turn impinges on photodiode $D_5$. Center line 66 indicates the relative alignment of the elements and the coin 12.

FIG. 4B illustrates in cross-sectional detail the manner in which the coin 12 eclipses the collimated light beam 60. The coin 12 in the center of FIG. 4B is shown in the position of maximum eclipse of collimated infrared beam 60. At that point the maximum amount of light 60 is blocked by coin 12 and the minimum amount of light 64 is received by photodiode $D_5$. The output of photodiode $D_5$ is sampled at very short intervals by microprocessor 20 to determine the point of minimal signal output which corresponds to the point of maximum coin eclipse of the collimated beam 60.

Two typical optically generated waveforms 74 and 76 are shown in FIG. 5C. Waveform 74 corresponds to the voltage signal generated by the passage of a twenty-five cent piece 12 whereas waveform 76 represents the signal generated by the passage of a ten cent piece 12. Since the twenty-five cent piece 12 is larger in diameter than the ten cent piece 12 it stands to reason that the twenty-five cent piece 12 blocks off more light than the smaller ten cent piece 12. Therefore, the peak of the twenty-five cent piece waveform 74 is greater than the peak of the ten cent waveform 76 since the twenty-five cent waveform 74 represents the eclipse of more light and therefore produces a greater voltage change across the output of amplifier circuit 30. The output of circuit 30 is also sampled by A/D converter circuit 18 under the control of microcomputer circuit 20 which stores the maximum voltage $V_p$ and the minimum voltage $V_M$ in memory. Microcomputer 20 then computes the following ratio:

$$A = \frac{V_M - V_O}{V_P - V_O}$$

where $V_O$=is the voltage from said optical area detecting means prior to the activation of said optical area detecting means;

$V_M$=is the minimum voltage output from said optical area detecting means after the activation of said optical area detecting means; and, $V_P$=is the absolute maximum voltage output from said optical area detecting means as a result of the passage of said coin.

The ratio A is representative of the surface area of the coin 12, and is invarient with respect to changes in the LED intensity of diode D4, the photodiode offset current, or the velocity of the coin 12 as it passes through the lens system 58 and 62. The ratio A and the output Peak voltage P from the piezo amplifier and integrator circuit 16 are compared against the stored acceptable range of values in the coin identification and time programming memory circuit 32. If a match is found within reasonably small tolerance values, the coin 12 is identified and accepted as valid. If a match is not found, the coin is identified as invalid. According to the preferred embodiment of the invention the coin 12, whether valid or invalid, drops into a coin box. However, according to alternative embodiments the invalid coin could be rejected and returned to the user.

The microcomputer 20 and the associated electronic circuitry is normally in the dormant state during which the device 10 draws a minimal amount of current $V_B$ from the battery. $V_B$ is sufficient to drive the LCD and flag display 38 but not sufficient to drive the LED $D_4$. In the dormant state microcomputer 20 is controlled by the 32.768 $kH_Z$ crystal controlled clock 34. The 32.768 $kH_Z$ clock rate is internally divided by microcomputer 20 to provide precision timing pulses for the internal circuitry. During the dormant state the remaining time on the meter is displayed by circuit 38 the details of which are illustrated in FIGS. 6H and 6I. The digital output of the apparatus 10 is updated every minute until time has expired as determined by the number of coins inserted into the meter 10. A liquid crystal red flag 120 is energized to indicate the "time expired" situation. The yellow flag 122 is preferably used as an overtime feature on some meters to indicate when the device 10 has timed down to zero time on the meter. The red flag 120 is then used to indicate the end of overtime limit (e.g. −2 hours). The preferred embodiment is capable of counting up to minus 9 hours and 59 minutes. In meters with no overtime feature the yellow flag 122 will only go on instantaneously as the circuit 10 passes through zero minutes then the red flag 120 goes on and the LCD display 124 will count the time in minus numbers. The foregoing operation would be typical of the use of the invention in the United States of America. However, in certain foreign countries, such as Great Britain, it is contemplated that the yellow flag 122 will be on between zero time on the meter and the overtime limit. After the overtime limit is reached, the red flag 120 will be on indicating a more serious violation. Since the device 10 is capable of measuring up to minus 9 hours and 59 minutes of overtime with LCD display panel 124 it would be possible to issue parking tickets in direct proportion to the amount of overtime actually accrued.

Figure 6C:
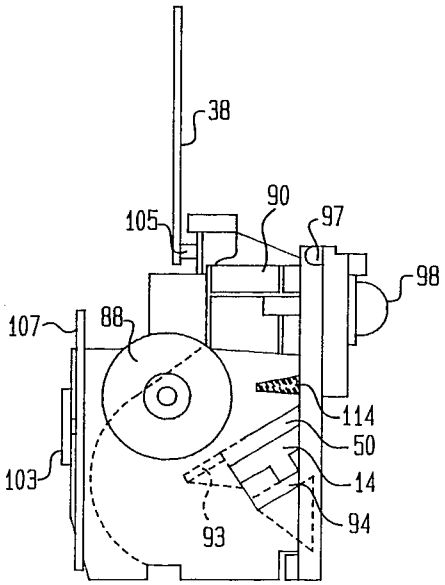
FIG. 6C is a left side elevational view of the parking meter assembly shown in FIG. 6B.
Figure 6B:
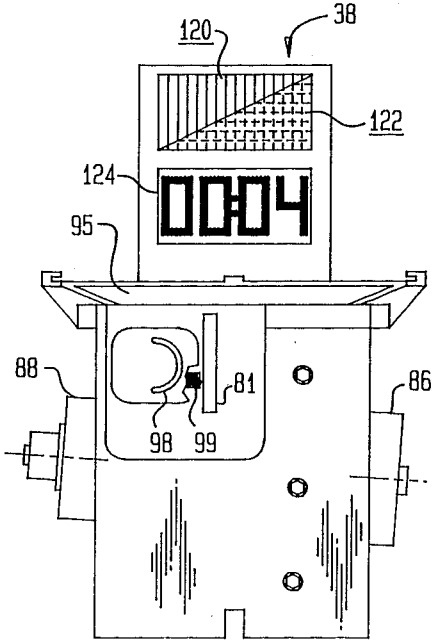
FIG. 6B is a front elevational view of the parking meter of FIG. 6A with the hood of the meter removed.
Figure 6A:
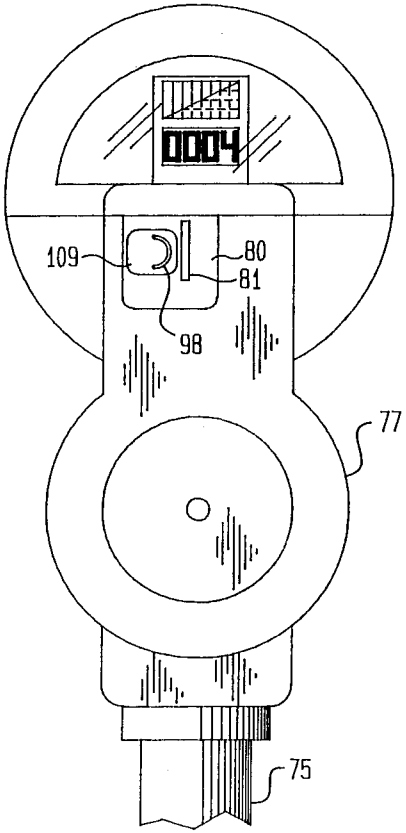
FIG. 6A is a front elevational view of an assembled parking meter embodying the present invention.
Figure 6E:
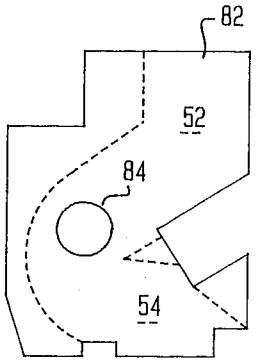
FIG. 6E is a side elevational view of one of the track plates that define the coin chute.
Figure 6D:
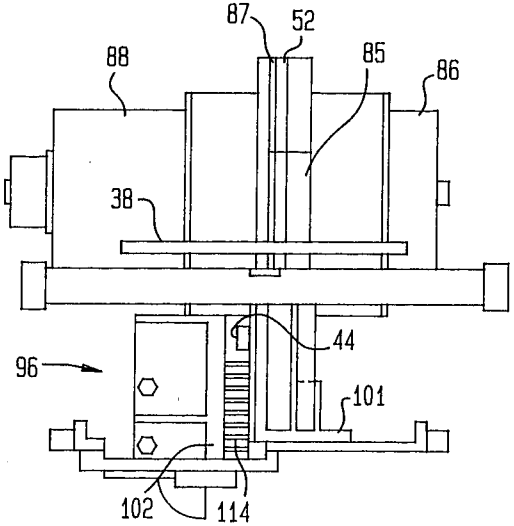
FIG. 6D is a top plan view of the parking meter assembly shown in FIG. 6B.
Figure 6F:
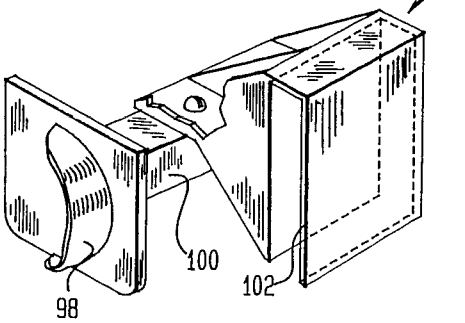
FIG. 6F is a perspective view of the coin entrance transfer block.
Figure 6H:
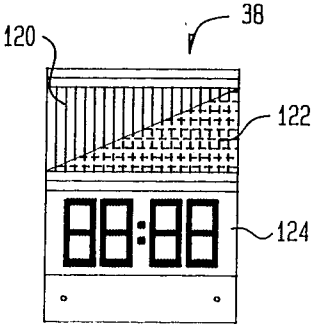
FIG. 6H is a front elevational view of the LCD flat assembly.
Figure 6I:
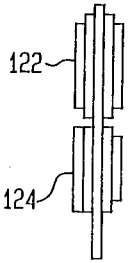
FIG. 6I is a side elevational view of the LCD flag assembly of FIG. 6H.

The internal and external mechanical portions of the invention are shown in detail in FIGS. 6A through 6I. A parking meter housing 77, 78 has a post 75 connected thereto and encloses all of the mechanical and electrical elements. Coin entrance piece 80 is the first mechanical element encountered by the customer as he inserts a coin 12 into the device 10. Coin slot opening 81 communicates with coin chute 52 such as illustrated in FIG. 3. Chute 52 is formed by a pair of mirror image frame pieces 82. Frame pieces 82 are formed from outer track sections 85 and 87. An aperture 84 in the frame pieces 82 is positiond at right angles across the path of chute 52. The chute comprises two region, namely the piezoelectric transducer region 52 and the photosensor area region 54. An internal housing 86 for the photodiode sectin 28 and another internal housing 88 for the LED electronic section 28 are located on opposite sides of aperture 84 so as to scan the path of the coin 12 as it progresses down the photosensor region of chute 54. A piezoelectric holding bracket 94 is positioned up-stream of aperture 84 and located so as to accomodate the piezoelectric transducer 14 and the cellulare urethane impact pad 50. A track damper 93 shown in FIG. 6C is used to minimize the bounce and jump of the coin as it rolls down the chute 52 and 54. Attached to main frame 97 is a bracket for supporting the piezoelectric transducer 14 and damping pad 50. A rate plate bracket 95 is also attached to the main frame 97 and serves to support a conventional rate card. The rate card is not illustrated because it does not help to further understand the invention. A return spring 99 attached to the coin translation box 90 returns the flange 109 to it home position. Spring 99 also serves to keep the translation box 90 away from wake-up limit switch 44 unless the translation handle 98 has been manipulated. A bracket 101 attached to main frame 97 serves to support tracks 85 and 87. The electronics circuit board 107 is attached to the back of the apparatus. The circuit board 107 includes most of the active elements of the invention 10 including the microprocessor 20. The LCD board 38 is connected to the apparatus by a spacer 105.

A molded coin entrance transfer block 96 is shown in detail in FIG. 6F. Transfer block 96 includes a handle section 98, an extension 100 and a pair of plates forming a box-like section 102 for translating the coin 12. Flange 109 serves to block the chute after a coin has been inserted and is being translated. The translation section 102 starts the coin 12 on its journey down chute 52 in response to manipulation of handle 98.

Figure 6G:
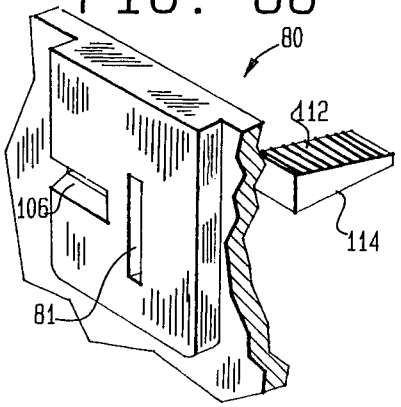
FIG. 6G is a perspective view of the coin entrance frame piece.
Figure 6K:
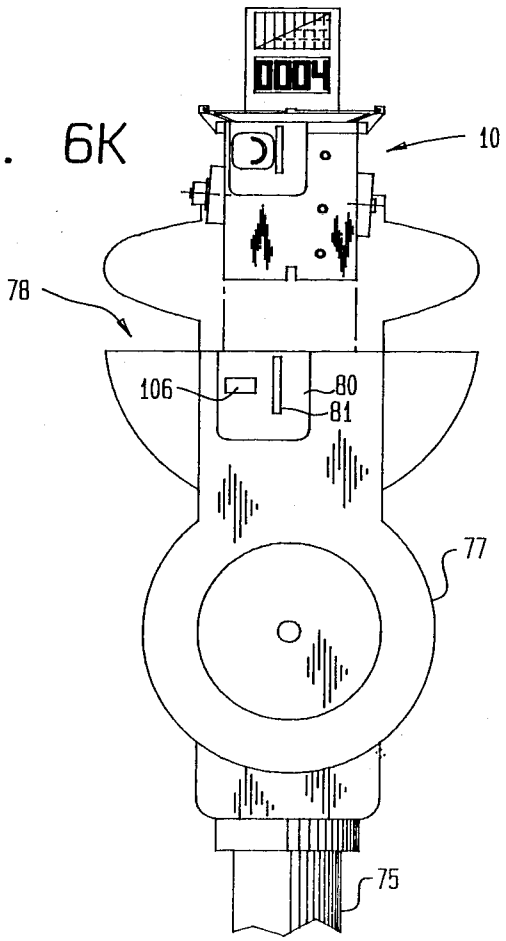
FIG. 6K is an exploded view showing how the parking meter housing receives the interchangeable electronic modules.
Figure 6J:
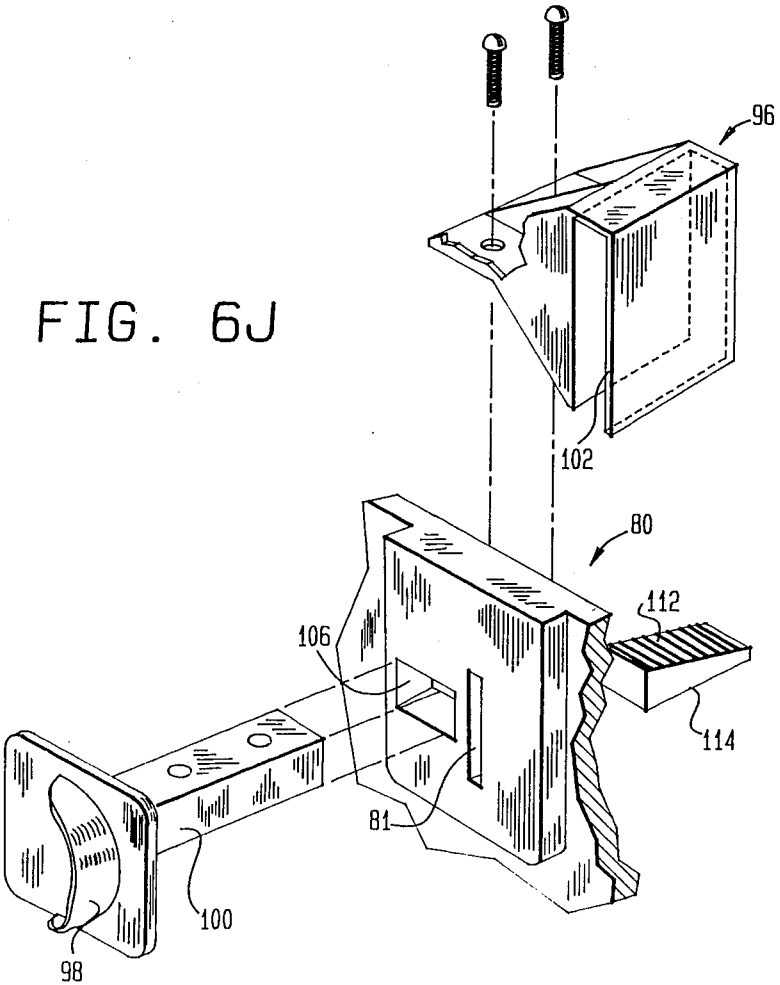
FIG. 6J is an exploded view of the coin transfer box and lever combination.

The coin entrance frame piece 80 is shown in greater detail in FIG. 6G. Handle slot 106 is adapted to receive the extension section 100 of the coin transfer block 96. Movement of the coin transfer block 96 along the length of slot 106 causes the translation box section 102 to move from the slot entrance 81 to the point where it releases the coin down chute 52. The coin entrance piece 80 may include a weather cap section which shields the coin slot 81 and the translation handle 98 from rain, snow and other elements. The tapered base 114 of the entrance piece 80 is shaped to center the coin 12 prior to its fall into chute 52. Parallel grid openings 112 in the base 114 allow moisture to pass through the entrance piece 80 without damaging the chute 52. It also serves to improve the resistance of the invention 10 from vandals who might employ liquids to gum up the internal works, and prevents entry into the coin measuring area of wires, etc.

In summary, the operation of the preferred parking meter embodiment 10 of the invention proceeds as follows. Initially it is assumed that there is no time on the meter and therefore the meter starts in the low power, dormant state. The red flag 120 would be illuminated under such circumstances. Starting with the foregoing assumptions, the meter user first places a coin 12 in coin entrance slot 81. The coin 12 is then held captive by the coin translation box section 102 of transfer block 96. Next the meter user pushes the transfer handle 96 along the length of slot 106 causing the coin 12 to fall off of the ledge formed by tapered base 114 and to start down chute 52. The movement of the handle 98 also causes the transfer block to activate wake-up switch 44 causing the circuitry 10 to change from its low power dormant state to its pre-active state. In the pre-active state the microprocessor 20 switches from the slow 32.768 $kH_z$ clock 33 to the higher frequency 400 $kH_z$ clock 35. The circuit 10 stays in the pre-active state for 500 milliseconds and returns to the dormant condition unless a signal is generated by the piezoelectric transducer 14.

Coin 12 next impinges upon the PVC impact pad 50 which covers piezoelectric transducer 14. The impact of coin 12 on piezoelectric transducer 14 produces impulse waveforms similar to plots 67 and 68 shown in FIG. 5A. The impulse waveforms 67 or 68 are integrated by amplifier and integrator circuit 16 and sampled by analog-to-digital converter circuit 18. The maximum value of the integrated waveform (such as 70 or 72 on FIG. 5B) is stored in memory by microcomputer unit 20 as a voltage P. The integrated signal produced by the impact of coin 12 on piezoelectric transducer 14 is directly proportional to the mass of the coin. If the voltage P is larger than a minimum threshold, the microcomputer brings the circuitry to a fully active state. Next the coin passes through the collimated light beam 60 producing an output signal similar to waveforms 74 and 76 in FIG. 5C. The troughs in the optical waveforms 74 and 76 represent the net crosssectional area of the coin. Therefore, a coin such as a dime with a hole in it, would generate a different waveform than a dime without a hole in it. The output from photodiode D5 in detector section 28 is sampled by analog-to-digital converter 18 and that minimum is also stored by computer 20. The stored value of the minimum is converted to a ratio A previously described as follows:

$$A = \frac{V_M - V_O}{V_P - V_O}$$

The light area ratio A, being characteristic of the net cross-sectional area of coin 12, is compared to acceptable ratios A stored in the coin identification and time programming memory circuit 32. If the ratio A is unacceptable the coin is rejected either by sending it to the coin box or by sending it through a reject chute. However, if the ratio A is acceptable, then the microcomputer 20 next compares the signal P which is representative of the maximum excursion of the integrated waveform 70 or 72 shown in FIG. 5B. If the integrated signal P is within the acceptable ranges stored in the coin identification and time programming memory unit 32, then the coin 12 is ultimately considered valid and forwarded to the coin box. If the coin fails the integral test, then it is either forwarded to the coin box and kept or forwarded to a reject coin chute and returned to the meter user. Presuming that the coin 12 has passed both the area ratio test A and the integral test P, the microprocessor 20 will then direct the LCD driver circuit 36 to cause the LCD readout section 124 to digitally display the amount of time available on the meter. The introduction of additional valid coins 12 into the device 10 will cause the microcomputer 20 to register more time on the LCD read out 124. As the meter section 10 times out under the control of the second clock 35, which operates at the clock rate of 32,768 $H_z$ the time displayed on read out 124 decreases. If the display reaches a certain minimum point, for example, zero, the yellow flag 122 might be activated. As the meter continues to time past zero then the red flag segment 120 will be activated when the overtime limit is reached. The preferred device has the capability of keeping track of overtime up to 9 hours and 59 minutes. On the average it takes about 300 milliseconds from the time that the coin 12 impacts on the piezoelectric transducer 14 to the time the circuit 10 returns to its dormant state.

Figure 7B:
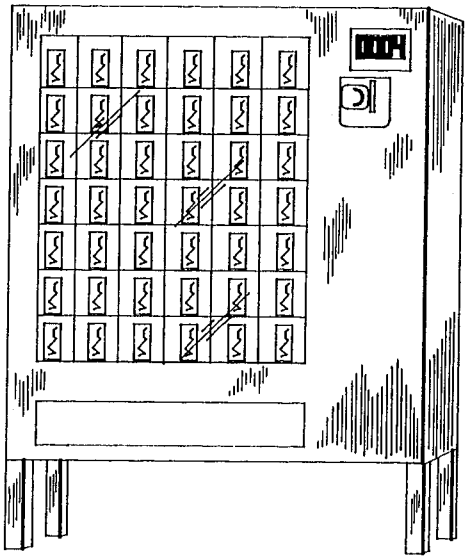
FIG. 7B illustrates the invention in the context of a vending machine.
Figure 7A:
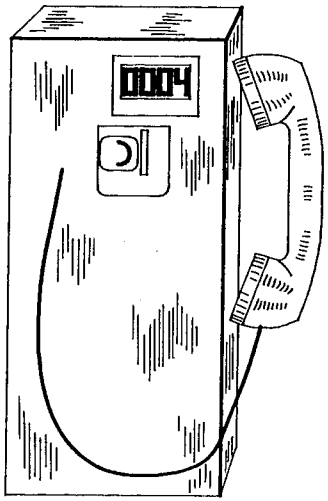
FIG. 7A illustrates the invention in the context of a telephone.

The preferred embodiment of the invention 10 comprehends use in the context of a parking meter. However, the basic coin discriminator 10 could also be used in other contexts. Note for example the use of the coin discriminator in the context of a public telephone 126 as shown in FIG. 7A. Alternatively, the coin discriminator is shown being employed in a conventional vending machine 128 as shown in FIG. 7B.

The coin discriminator 10 just described in detail has several major advantages over the prior art. First of all, the device uses a small amount of power since it is only in the high power active state for a short period of time. Second, by eliminating many of the mechanical parts associated with conventional parking meters and the like, it is possible to substantially increase the reliability of the parking meter due to the fact that fewer parts wear out. Third, since many of the parts are formed from integratable electronic elements, it is possible to achieve substantial reductions in cost due to increased economies of scale. Fourth, the device is highly accurate because it is controlled by a very reliable frequency standard. Fifth and last, the device is capable of discriminating with great precision between valid and invalid coins. The power of coin discrimination is believed to be substantially greater than that of conventional mechanical coin discriminators.

There are certain features of the invention that can be modified according to the teachings of the invention. For example, while the preferred embodiment of the invention comprehends the use of a wake-up switch 44 to cause the device to change from the dormant state to the active state, it is possible that the wake-up switch 44 could be eliminated and the impulse signal created on the piezoelectric element 14 used as the wake-up signal. In other words, the impulse signal generated by the coin 12 could serve the dual function of waking up the microprocessor 20 and providing an electrical measurement of the impact of the coin on the piezoelectric element 14 as well as turning on LED $D_4$. The invention 10 could also be associated with a coin reject chute which operates in the conventional fashion to return a non-accepted coin to the meter user.

While the invention has been described with reference to a preferred embodiment thereof it will be appreciated by those of ordinary skill in the art that various changes can be made to the structure and function of the parts without departing from the spirit and scope of the invention as a whole.

I claim:

1. An apparatus for discrimination of coin objects, including legal currency, tokens and slugs, of regular and irregular shape comprising:

drop means for causing a coin to fall through a predetermined distance;

a piezoelectric means for receiving the impact of said coin after it has fallen through said predetermined distance;

coin mass detecting means connected to said piezoelectric means for determining the mass of said coin from the impact of said coin on said piezoelectric means, said detecting means including means for rejecting said coin if the mass thereof as determined by the coin mass detecting means does not fall within predetermined limits.

2. The apparatus of claim 1 further comprising:

optical means for determining the area of said coin, said area including the area of irregular peripheral projections for non-circular coins and excluding the area of holes or like apertures in the coins whereby the actual area of the coin is accurately measured.

3. The apparatus of claim 1 wherein said apparatus is incorporated into a parking meter.

4. The apparatus of claim 1 further comprising:

vending means associated with said coin discrimination apparatus for vending articles in response to the detection of valid coins.

5. The apparatus of claim 1 further comprising:

telephone means connected to said coin discrimination apparatus for providing telephone services in response to the detection of valid coins.

6. An apparatus for discrimination of coin objects, including legal currency, tokens and slugs, of regular and irregular shape comprising:

drop means for causing a coin to fall through a predetermined distance;

a piezoelectric means for receiving the impact of said coin after it has fallen through said predetermined distance;

optical means for determining the area of said coin, said area including the area of irregular peripheral projections for non-circular coins and excluding the area of holes or like apertures in the coins whereby the actual area of the coin is accurately measured;

coin mass detecting means connected to said piezoelectric means for determining the mass of said coin from the impact of said coin on said piezoelectric means, said detecting means including means for rejecting said coin if the mass thereof as determined by the coin mass detecting means does not fall within predetermined limits;

a power supply means for supplying a voltage $V_D$ to said apparatus when said apparatus is in a dormant state and for supplying voltage $V_A$ to said apparatus when said apparatus is in an active state; and, circuit energizing means responsive to the presence of said coin in said apparatus for causing said apparatus to assume an active state by applying the voltage $V_A$ to said apparatus in response to the introduction of said coin in said apparatus, said active voltage $V_A$ being greater than said dormant voltage $V_D$.

7. An apparatus for discrimination of coin objects, including legal currency, tokens and slugs, of regular and irregular shape comprising:

drop means for causing a coin to fall through a predetermined distance;

a piezoelectric means for receiving the impact of said coin after it has fallen through said predetermined distance;

optical means for determining the area of said coin, said area including the area of irregular peripheral projections for non-circular coins and excluding the area of holes or like apertures in the coins whereby the actual area of the coin is accurately measured; said optical area determining means includes:

optical scanning means for scanning said coin and producing an output proportional to the area of said coin and, microprocessor means connected to said optical scanning means for digitally sampling the output from said optical scanning means and storing a value proportional to the maximum excursion of said signal when said coin is scanned by said optical scanning means;

coin mass detecting means connected to said piezoelectric means for determining the mass of said coin from the impact of said coin on said piezoelectric means, said detecting means including means for rejecting said coin if the mass thereof as determined by the coin mass detecting means does not fall within predetermined limits.

8. The apparatus of claim 7 wherein said coin mass detecting means includes:

integrating means for integrating an output from said piezoelectric means and producing a signal proportional to the mass of said coin.

9. The apparatus of claim 8 further comprising:

coin shock absorbing means for contacting said piezoelectric means and for absorbing some of the shock from said coin as said coin drops on said piezoelectric means.

10. The apparatus of claim 9 further comprising:

switch means responsive to the insertion of a coin into said apparatus for producing a wake-up signal to preactivate said microprocessor means.

11. The apparatus of claim 9 wherein the impact of a coin on said piezoelectric means produces a wake-up signal to preactivate said microprocessor means.

12. The apparatus of claim 9 further comprising:

first clock means for supplying clock pulses to said microprocessor means when said apparatus is in said dormant state.

13. The apparatus of claim 12 further comprising:

second clock means for supplying clock pulses to said microprocessor means when said apparatus is in a preactive state and said active state and wherein a frequency of said second clock means is higher than a frequency of said first clock means.

14. The apparatus of claim 13 further comprising:

analog-to-digital converter means controlled by said microprocessor means for determining information by sampling outputs from said coin mass detecting means and said optical area determining means and forwarding said information to said microprocessor means.

15. The apparatus of claim 14 further comprising:

memory means connected to said microprocessor means for storing information relative to the identification of valid coins.

16. The apparatus of claim 15 further comprising:

liquid crystal display means for producing a visual output representative of the identification of a valid coin.

17. An apparatus for discrimination of coin-like objects, including legal currency, tokens, and slugs, of regular and irregular shape comprising:

a piezoelectric means for receiving the impact of a coin;

a coin mass detecting means connected to said piezoelectric means for determining the mass of said coin from the impact of said coin on said piezoelectric means, said coin mass detecting means including an integrating means for integrating an output of said piezoelectric means and producing an output proportional to the mass of said coin;

optical area detecting means for determining the area of said coin after it contacts said piezoelectric means, said optical area detecting means including an optical scanning means for scanning said coin and producing an output proportional to the area of said coin, said area including the area of irregular peripheral projections for non-circular coins and excluding the area of holes or like apertures in the coins whereby the actual area of the coin is accurately measured; and, microprocessor means connected to said coin mass detecting means and said optical area detecting means for comparing the outputs from said coin mass detecting means and said optical area detecting means with predetermined value ranges of coin mass and coin area to determine if said coin is valid.

18. The apparatus of claim 17 further including:

power supply means for supplying a voltage $V_D$ to said apparatus when said apparatus is in a dormant, lower power consumption state and for supplying a voltage $V_A$ to said apparatus when said apparatus is in an active, coin discrimination state, said voltage $V_A$ being greater than said voltage $V_D$; and, means for detecting the presence of said coin in said apparatus prior to the scanning of said coin by said optical scanning means and for applying said voltage $V_A$ to said apparatus and for disconnecting said voltage $V_D$ from said apparatus.

19. An apparatus for discrimination of coin objects, including legal currency, tokens and slugs, of regular and irregular shape comprising:

a piezoelectric means for receiving the impact of a coin;

a coin mass detecting means connected to said piezoelectric means for determining the mass of said coin from the impact of said coin on said piezoelectric means, said coin mass detecting including an integrating means for integrating an output from said piezoelectric means and producing an output voltage P proportional to the mass of said coin;

optical area detecting means for determining the area of said coin after it contacts said pieezoelectric means, said optical area detecting means including an optical scanning means for scanning said coin and producing an output $V_P$ proportional to the area of said coin, said area including the area of irregular peripheral projections for non-circular coins and excluding the area of holes or like apertures in the coins whereby the actual area of the coin is accurately measured; and, microprocessor means connected to said optical area detecting means and said coin mass detecting means for producing a ratio A characteristic of a coin wherein $$A = \frac{V_M - V_O}{V_P - V_O}$$

where $V_O$=the voltge from said optical area detecting means prior to the activation of said optical area detecting means; and, $V_M$=the minimum voltage output from said optical area detecting means after the activation of said optical area detecting means; and $V_P$=the absolute maximum voltage output from said optical area detecting means as a result of the passage of said coin, wherein said microprocessor means compares the value of ratio A and output P with value ranges representative of valid coins to determine if said coin is valid.

20. A coin discrimination apparatus comprising:

coin receiving means including a first slot for receiving a coin;

coin translating means for moving said coin from said coin receiving means to a coin dropping area;

chute means for receiving said coin from said coin dropping area and for causing said coin to fall a predetermined distance;

coin mass detecting means located in said chute means for receiving the impact of said coin after it has fallen said predetermined distance; and, integrating means attached to said coin mass detecting means for integrating an output of said coin mass detecting means and for producing a voltage proportional to the mass of said coin; and means for rejecting said coin if the mass thereof as determined by the coin mass detecting means does not fall within predetermined limits.

21. The apparatus of claim 20 further comprising:

optical area detecting means for determining the area of said coin after it contacts said coin mass detecting means; and, microprocessor means connected to said optical area detecting means for comparing an output from said optical area detecting means with predetermined values of coin area to determine if said coin is valid.

22. The apparatus of claim 21 wherein said coin translating means includes:

a handle means for a user to translate the coin;

a box-like means for receiving said coin from said coin receiving means; and, extension means for connecting said handle means to said box-like means.

23. The apparatus of claim 22 wherein said coin receiving means includes:

a front face having said first coin receiving slot therein and further including a second slot for receiving said extension means between said handle means and said box-like means of said coin translating means; and, a base means at substantially right angles to said front face of said coin receiving means for forming a ledge, wherein movement of said handle means causes said box-like means to translate said coin from said first slot area to said coin dropping area which is located at an edge of said base means.

24. The apparatus of claim 23 wherein the base means of said coin receiving means includes grid-like apertures therein for allowing moisture to pass therethrough.

25. The apparatus of claim 24 wherein said coin translation means further includes:

spring means for biasing said handle means a flange means connected to said handle means for normally blocking said second slot under the influence of said spring means.

26. The apparatus of claim 25 further including:

a switch means for producing a wake-up signal for said microprocessor means attached to said apparatus, wherein the translation of said handle means to cause said coin to drop down said chute means causes said box-like means to contact and activate said switch means producing said wake-up signal for said microprocessor means.

* * * * *